US005798946A

United States Patent [19]

Khesin

[11] Patent Number: 5,798,946

[45] Date of Patent: Aug. 25, 1998

[54] SIGNAL PROCESSING SYSTEM FOR COMBUSTION DIAGNOSTICS

[75] Inventor: Mark Khesin, North Andover, Mass.

[73] Assignee: Forney Corporation, Carrollton, Tex.

[21] Appl. No.: 580,422

[22] Filed: Dec. 27, 1995

[51] Int. Cl.[6] ..... G08B 17/12; F23N 5/08

[52] U.S. Cl. ..... 364/551.01; 340/578; 431/79; 431/12

[58] Field of Search ..... 364/551.01, 550; 340/500, 577, 540, 578; 431/12, 75–79; 250/554

[56] References Cited

U.S. PATENT DOCUMENTS

| | | | |
|---|---|---|---|
| 3,936,648 | 2/1976 | Cormault et al. | 250/554 |
| 4,039,844 | 8/1977 | MacDonald | 250/554 |
| 4,370,557 | 1/1983 | Axmark et al. | 250/554 |
| 4,639,717 | 1/1987 | De Meirsman | 340/578 |
| 4,709,155 | 11/1987 | Yamaguchi et al. . | |
| 4,866,420 | 9/1989 | Meyer, Jr. | 340/578 |
| 5,073,769 | 12/1991 | Kompelien | 340/578 |
| 5,076,780 | 12/1991 | Erdman | 431/24 |
| 5,077,550 | 12/1991 | Cormier | 340/578 |
| 5,191,220 | 3/1993 | Innes | 250/554 |
| 5,257,496 | 11/1993 | Brown et al. | 60/39.6 |
| 5,332,386 | 7/1994 | Hosome et al. | 431/12 |

FOREIGN PATENT DOCUMENTS

| | | |
|---|---|---|
| 0 476 601 A | 3/1992 | European Pat. Off. . |
| 0 581 451 A | 2/1994 | European Pat. Off. . |

*Primary Examiner*—Emanuel T. Voeltz
*Assistant Examiner*—Bryan Bui
*Attorney, Agent, or Firm*—Wolf, Greenfield & Sacks, PC

[57] ABSTRACT

A signal processing method and apparatus for analyzing operation of a combustion burner. Responsive to a signal produced by a flame sensor which monitors a burner flame, a fluctuational component of the signal is converted into an extremum function having a floating extremum point with a frequency coordinate which varies in the frequency domain with changes in combustion conditions. A current extremum value of the extremum function is calculated. Then, in relation to the current extremum value, a value of at least one parameter of the extremum function is calculated, such function being related to the combustion characteristic. The apparatus comprises a processor and memory coupled thereto, the memory having stored therein a plurality of instructions which, when executed by the processor, cause the processor to perform the aforementioned operations.

28 Claims, 6 Drawing Sheets

SIGNAL PROCESSING SYSTEM FOR COMBUSTION DIAGNOSTICS

FIELD OF THE INVENTION

The proposed invention relates to flame sensing and adjustment procedures and systems for use in conjunction with a boiler, furnace or similar combustion apparatus. More particularly, it relates to procedures and systems usable with flame sensors to produce signals indicative of characteristics of an individual flame in a multiple burner system, to facilitate the formulation of recommendations for burner adjustment.

BACKGROUND OF THE INVENTION

In numerous industrial environments, a hydrocarbon fuel is burned in a boiler or furnace to produce heat to raise the temperature of a fluid. The fluid may be water, for example, and the water may be heated to generate steam to drive turbine generators which provide electrical power as output. Such industrial furnaces typically employ an array of many individual burner elements to combust the fuel. For the furnace to operate efficiently and to produce an acceptably complete combustion whose byproducts fall within the limits imposed by governmental regulations and design constraints, all of the individual burners must be operating cleanly and efficiently. Emissions of nitrous oxides or other byproducts generally are monitored to ensure compliance with environmental regulations. The monitoring heretofore has been done, by necessity, on the aggregate emissions from the furnace (i.e., the entire burner array, taken as a whole). When a particular combustion byproduct is found to be produced at unacceptably high concentrations, the offending burner(s) must be serviced to restore proper operations. However, measurement of the aggregate emissions does not provide any indication which burner or burners should be adjusted or what parameters of burner operation should be changed.

To achieve the goal of stable and efficient operation of any combustion apparatus, individual burners have to be adjusted to achieve the optimum ratio between the fuel and air flows, the optimum distribution between individual air flows, and the optimum setting of other burner adjustments. Most industrial and utility boilers are equipped with flame monitoring devices (flame scanners) for individual burners. The function of these scanners is to determine the presence of individual burner flames and to achieve reliable flame discrimination (flame detection) between individual burner flames and the furnace's background fireball.

The primary sensor output signal generated in a flame scanner has two components: intensity and fluctuating frequency. One of them or a combination of both is used for flame detection. The fluctuating component can be processed via a spectral analysis algorithm, for example converted from time domain into frequency domain using a Fast Fourier Transform (FFT). The fluctuating flame component is known to be highly sensitive to changes in flame conditions. Extensive experimental testing of burners and flame scanners and the corresponding data analysis have demonstrated that the pattern of distribution in the frequency domain can be correlated with flame stability, combustion efficiency and byproduct (e.g., $NO_x$) formation, and can be utilized to monitor and optimize the operating conditions of individual burners. A number of efforts in the prior art have been concentrated on developing methods for the practical utilization of flame scanner output signals for the purpose of effective combustion diagnostics, despite their chaotic nature and high noise level.

Correlation of flame fluctuation (or "flicker") with flame quality and emissions can be understood as follows. In individual burner flames, the combustion process is dominated by the rate of mixing of fuel and air, while the chemical kinetics are much faster. Each burner flame consists of a multitude of various size recirculation loops and eddies inside and around the flame. Furthermore, the flame itself is comprised of turbulent eddies or flamelets which travel inside of the recirculation loops. These recirculation loops and eddies contribute to generating the flame flicker at various frequencies. The flicker phenomena is the result of turbulent mixing through eddy formation at the edges of the fuel and air jets. Shorter loops and smaller eddies occur more frequently and generate higher frequencies, and vice versa.

The movement of eddies in turbulent flows affects the mixing rate of air and fuel in turbulent diffusion flames. Every time a turbulent eddy occurs, it mixes fuel (for example, coal or pyrolysis products) with air. The amount of fuel and air mixed is controlled by the size of the eddy. Since combustion kinetics are fast compared to these turbulent mixing times, the fuel and air are combusted essentially instantly. Because a large eddy may entrain more fuel than a smaller eddy, a larger eddy should give a larger emission intensity. Each flame characteristic is associated with a dominant group of eddies which, in turn, generate a dominant segment in the frequency domain. The pattern of distribution of fluctuational energy in the frequency domain which is a function of flame turbulence and fuel-air mixing rate can be correlated with specific flame parameters.

Analyzing flame parameters in the frequency domain, based on the "eddy concept", it is desirable to take into account that large size eddies occur "one at a time" producing individual energy spikes at relatively low frequencies. Smaller eddies produce smaller energy spikes but occur more frequently, and their emitted energy has a cumulative effect. A signal analysis in the frequency domain should take into account several important factors. It should discriminate and provide a separate approach to the effects of the large-scale turbulence, mostly related to the mixing process, and small-scale turbulence corresponding to energy dissipation in turbulent eddies.

For real-life combustion systems, actual flame conditions and characteristics vary significantly, depending on boiler and burner design, type of fuel, interactions between adjacent burners, and many other factors. Optimum algorithms determined for one situation may not be applicable to another. Moreover, optimum algorithms for a certain set of burner conditions may not be the best for another set of conditions on the same burner.

SUMMARY OF THE INVENTION

The foregoing objectives are achieved and obstacles overcome by a system which processes the output of a sensor to extract signals characteristic of burner operation. These signals include signals characteristic of flame stability as well as signals characteristic of combustion quality. The flame sensor detects flame radiation from a combustion apparatus to sense a desired flame characteristic, for example NOx. The sensor produces an electric signal indicative of the detected radiation. The signal is converted, via dynamic signal processing, into a function having a (preferably single) maximum or minimum in a range of interest—generically called an extremum function (e.g., bell curve) with an extremum (called the "bell" point) the magnitude and location of which float in the frequency domain. Preferably, the extremum (i.e., the magnitude of the function at the minimum or maximum), and the frequency location of the extremum, is set up or adjusted to match burner operating conditions. Using this function as a basis, the signal is divided into frequency segments and dynamically normalized; the resulting frequency-limited signals characterize the large-scale and the small-scale turbulence zones in the frequency domain. The flame characteristics are determined by a considering in combination of one or more selected statistical parameters of the bell curve derived from the signals in selected frequency segments, along with one or more limiting conditions such as the degrees of scattering (i.e., standard deviation) of those or other parameters.

That is, the invention includes a signal processing method and system which determines a combination of burner flame characteristics by calculating from each flame sensor output a set of preselected statistical parameters in various frequency segments of a selected extremum function. The system calculates the bell point, then calculates the frequency segments and one or more preselected statistical values for the signal in each frequency zone, along with their degrees of scattering; a single such statistical value or combination of such values is utilized as an indicator of the required flame parameters for the specific burner and flame conditions.

The invention will be more fully understood from the detailed description which follows, which should be read in conjunction with the accompanying drawing.

DETAILED DESCRIPTION

Figure 1:
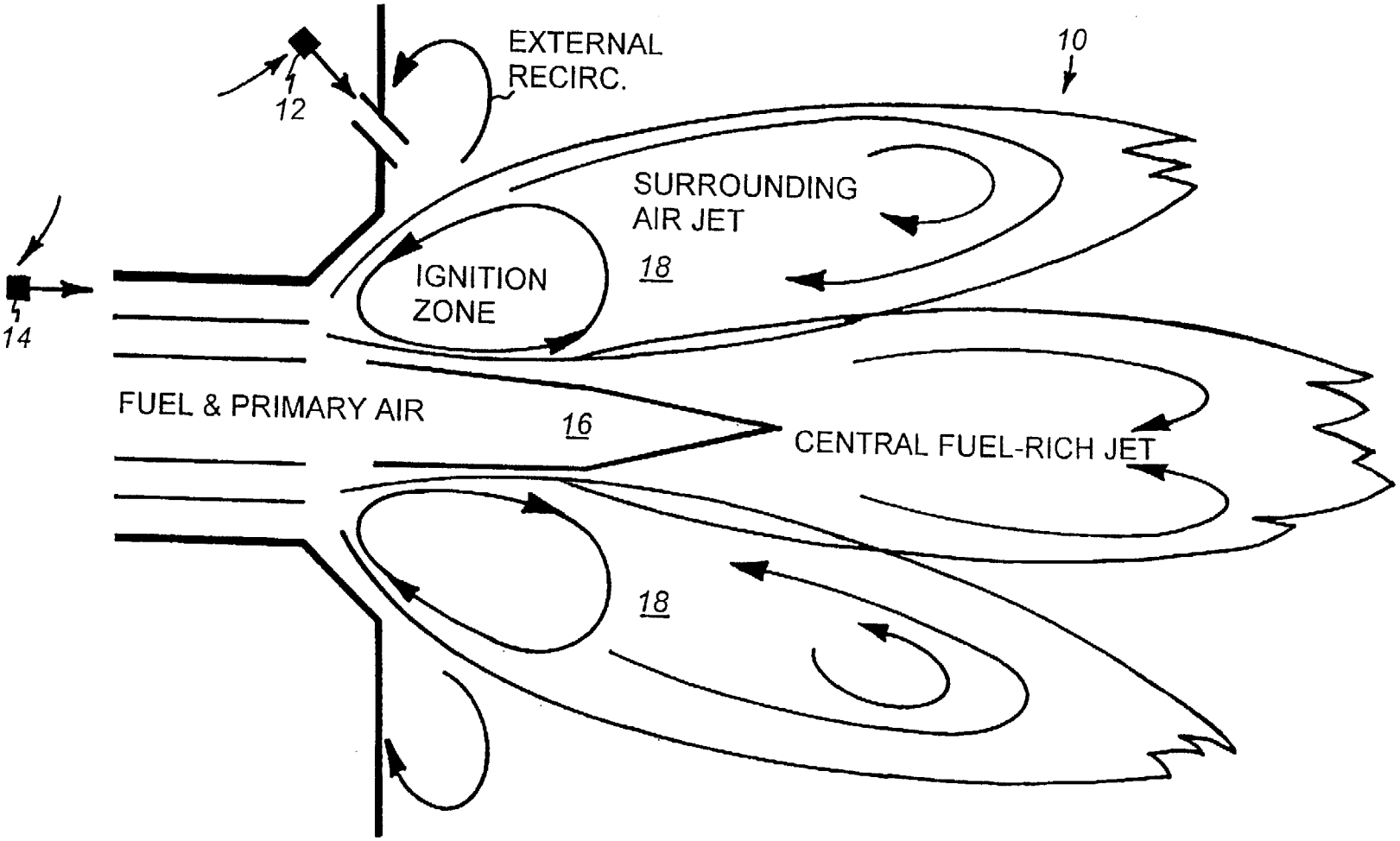
FIG. 1 presents a diagramatic illustration in cross-section of a burner flame and typical sightings of flame sensors used to monitor the flame.

Turning to FIG. 1, shown there is a cross-sectional diagramatic illustration of a burner flame 10 and typical sighting of two flame sensors 12 and 14 used to monitor the flame. In practice, one, two or more sensors may be employed for each flame. An industrial burner flame comprises several concentric jets; usually a central core jet 16 of fuel and primary air is surrounded by secondary air streams 18, respectively. The fuel-air mixing and the combustion process are highly turbulent. The flame consists of a chaotic multitude of recirculation loops and turbulent eddies of various sizes. Turbulence in the flame is often divided into two major types: large-scale and small-scale turbulence. The large-scale turbulence is considered to be associated mostly with the fuel-air mixing processes and the small-scale turbulence is associated with combustion kinetics and energy dissipation in small eddies. The overall combustion turbulence reflects the process of energy transfer from large-scale recirculation loops to smaller and smaller eddies down to the molecular level. The rate of the mixing process and the intensity of these turbulent activities determine the flame stability and combustion efficiency; they also directly relate to the processes of formation and destruction of NOx and combustibles. Most of these chaotic turbulent activities begin and occur in the ignition zone.

The AC (fluctuating) component of the signal generated in a radiation sensor aimed into the ignition zone of the controlled flame reflects these turbulent activities. It has been demonstrated that the AC component is sensitive to changes in flame conditions. When converted to the amplitude spectrum in the frequency domain and properly processed, the spectrum (often called "flame signature" and expressed mathematically as an amplitude A which is a function of frequency—i.e., A(F)), yields statistical parameters which can be correlated with the flame parameters of interest, such as NOx, CO and flame stability. (Of course, power spectrum can be used instead of amplitude spectrum.) Generally, all statistical parameters in various segments of the spectrum are sensitive to flame changes. However, the degree of this sensitivity varies significantly with frequency. These variations in sensitivity can be explained, if it is assumed that different combustion processes are associated with certain types of turbulence, i.e., with some dominant groups of eddies and, therefore, with some specific frequency bands, or segments, in the spectrum. For example, if chemical reactions producing NO are mostly related to a certain group of turbulent eddies, which are, in turn, related to a certain frequency segment in the spectrum, then the best correlations with NO will be found by processing statistical parameters in this frequency segment. However, the size and the location of this frequency segment may vary following changes in burner firing conditions. Thus it is important to determine this optimum frequency segment at varying burner and flame conditions.

Figure 2A:
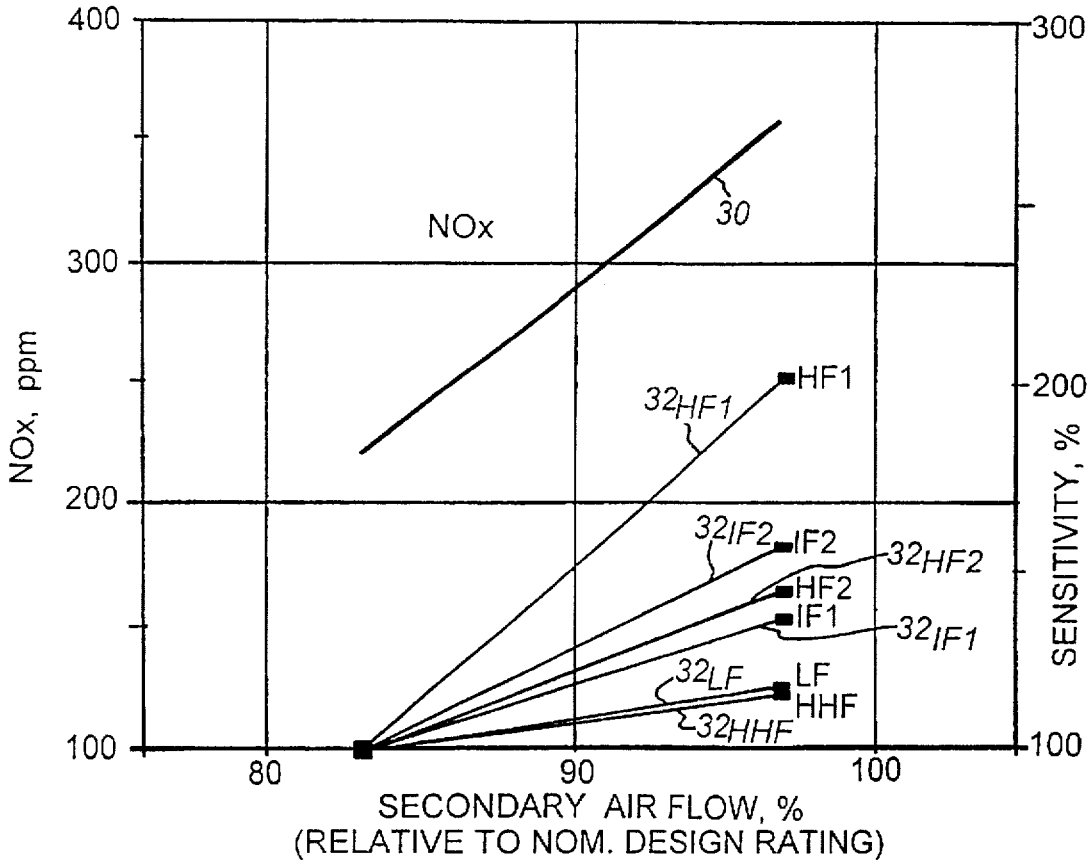
FIGS. 2*a* and 2*b* are graphs illustrating variations in sensitivity of statistical parameters calculated at different frequency segments for a single coal-fired burner in relation to NOx changes.
Figure 2B:
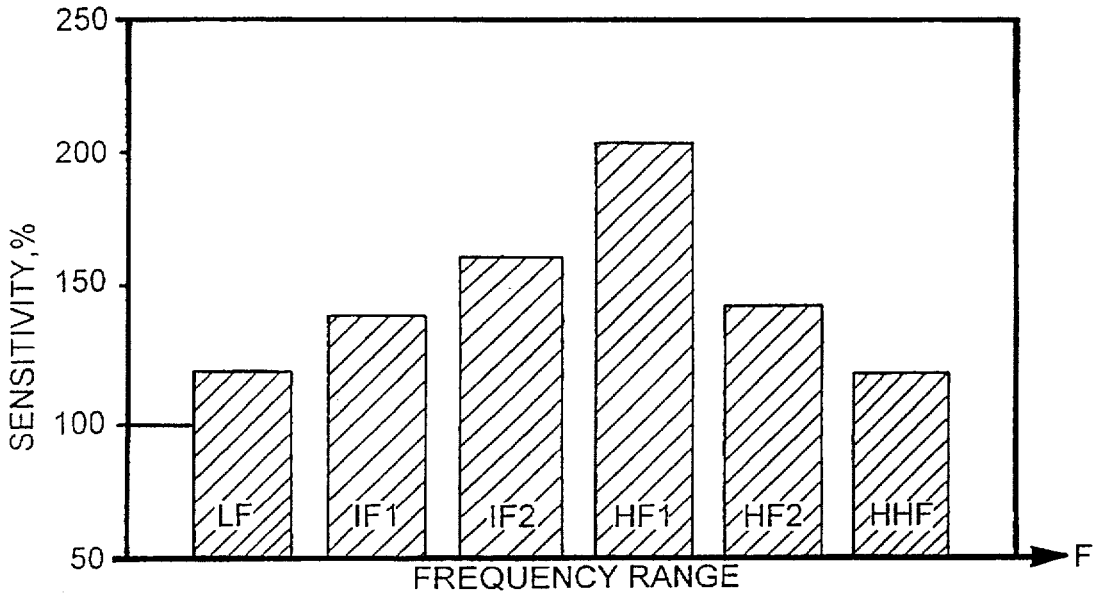

FIGS. 2*a* and 2*b* illustrate variations in sensitivity of a selected statistical parameter calculated for different frequency segments for an exemplary single coal-fired burner. To generate these graphs, the frequency spectrum (flame signature) of a flame sensor output signal was divided into several segments (labeled in this illustration LF, IF1, IF2, HF1, HF2, HHF), each segment having a predetermined bandwidth and occupying a particular portion of the frequency spectrum. Then certain statistical parameters, such as average amplitude and slope, were calculated for each segment. One such parameter was selected to be shown; the specific definition of this parameter is not important for purposes of explaining the inventive concept, as those skilled in the art will select parameters appropriate to the type of fuel and burner being monitored. Burner firing conditions then were changed incrementally (in this particular case, the air flow to the burner was redistributed: the tertiary air flow (not illustrated) was reduced and the secondary air flow was increased, while the total air flow remained constant). The changes in the calculated statistical parameters were compared in relation to the measured changes of NOx for this burner.

As seen in FIG. 2a, NOx emissions (in parts per million) vary from about 220 at 83% secondary air flow (relative to nominal design rating for the subject burner) to about 360 ppm at 97% secondary air flow. (Graph 30.) The graphs $32_{HHF}$, $32_{LF}$, $32_{IF1}$, $32_{HF2}$, $32_{IF2}$, and $32_{HF1}$ depict the variation of a selected parameter of the flame sensor signal with secondary air flow. (As stated above, the parameter could be an area or slope of the signal, for example.) On the right side of FIG. 2a, a scale is provided by which the sensitivities of graphs $32_{HHF}$ . . . $32_{HF1}$ are plotted. (Sensitivity, in this context, is expressed as a percentage change in the parameter as compared with a base value for the parameter.) Redrawing the data by plotting, in bar graph form, the sensitivity information for each frequency segment, results in FIG. 2b.

For a different parameter or different operating conditions, or a different fuel or a different burner, the graphs of FIGS. 2a and 2b will differ correspondingly, of course.

FIGS. 2a and 2b show that sensitivity of a specific statistical parameter calculated at different frequency segments varies significantly, i.e., from 15% to 100% in this example, and a particular frequency segment HF1 provides the highest sensitivity to changes of NOx.

The specific frequency segment which provides the best sensitivity at the lowest noise level (i.e., the highest signal-to-noise ratio) in relation to a selected flame parameter (e.g., NOx) generally is not static, though. The location of this frequency segment may change from moment to moment, particularly following changes in burner operation, (e.g., changes in burner load or fuel-to-air ratio). Contemplated solutions to this problem have included the application of methods of artificial intelligence, such as neural networks or fuzzy logic, to learn and calculate, on a continuous or periodic basis, the optimum frequency segments and functions correlated with parameters of interest. Such approaches at best would require an enormous amount of computing power and lead to very complicated systems, which apparently have not been implemented successfully.

According to the present invention, by contrast, a certain new function, identified as Y, is formed. This function depends on both flame sensor signal amplitude, A, and frequency, F, and changes (or floats) with changes in flame conditions in such a way as to provide a natural dynamic reference for selecting the frequency segment in which a selected parameter is most sensitive to, or indicative of, a selected combustion characteristic (e.g., NOx, CO, etc.). That is, Y=f[A,F] in the frequency domain. Y is not a single, specific function but, rather, any single-valued extremum function. The function Y is characterized by a special feature: a well-defined maximum value $Y_{max}$ positioned at a frequency $F_{max}$ within a band of interest. The position of this maximum value is referred to as an "extremum" point. The extremum "coordinates" $Y_{max}$ and $F_{max}$ exhibit the following behavior: (1) they change with changes in flame conditions; (2) they are adjustable (by changing the generating function, f) to provide a natural floating threshold between the large-scale and small-scale turbulence; (3) they will provide a natural dynamic reference point for calculation of normalized statistical values; and (4) they will compensate automatically, at least to a degree, for the effects of spatial averaging with increasing frequencies. A suitable extremum function must depend on both a magnitude and frequency, and graphs as a bell curve with a floating (preferably adjustable) extremum point at $Y_{max}$ and $F_{max}$ (the bell point) to meet the above requirements and provide an effective solution to the above problem.

Figure 3A:
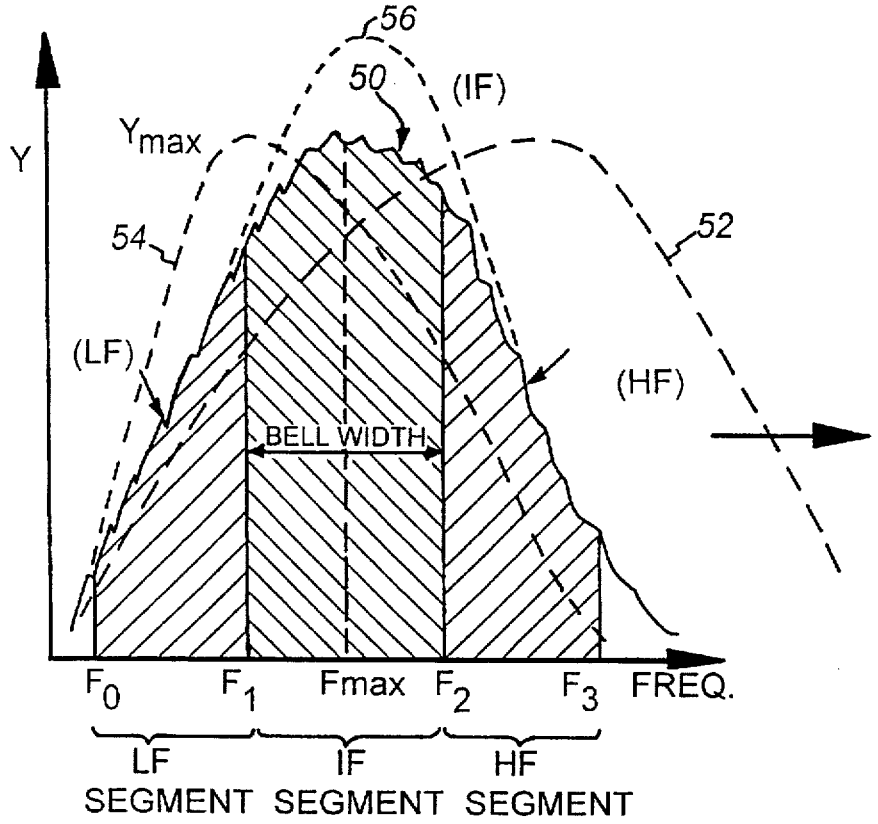
FIG. 3*a* is a graphical illustration of an exemplary frequency-dependent extremum function according to the invention.
Figure 3B:
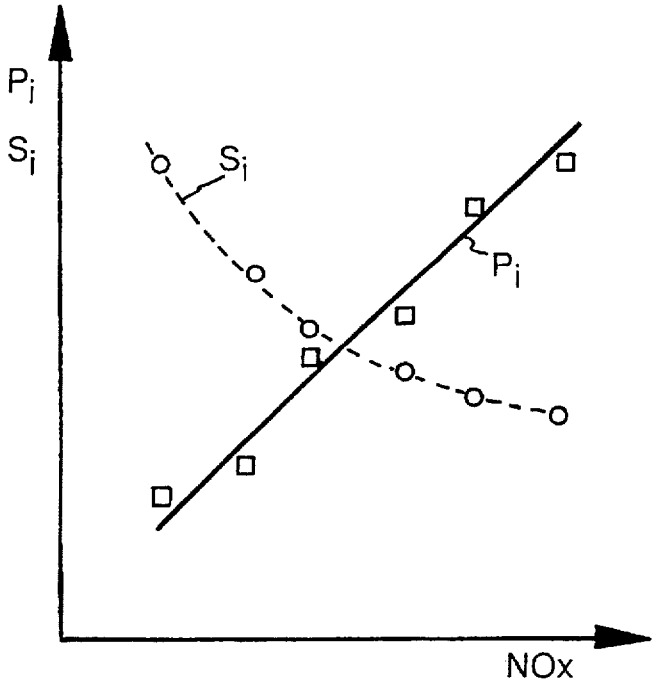
FIG. 3*b* is a graph of the resulting correlation of values for a selected parameter "p" in a frequency segment "T" (i.e., $p_i$) and the associated scattering function (i.e., standard deviation), "$s_i$", with NOx, for the function of FIG. 2*a;*

FIG. 3a illustrates an example 50 of such an extremum function. This function can be formed (i.e., computed), for example, as $$Y=kf_1(A)^m f_2(F)^n$$

where functions $f_1$ and $f_2$ may be presented in exponential or logarithmic form, and exponents m and n are tuning parameters which are selected for a certain fuel, type of burner and operating conditions. The exponents m and n, or either of them, may be changed, for example, if operating condition or fuel is changed. A simple example is function $$Y=k(\log A)^{F^m}.$$

where $k=F_{co}/(\log A)_0$;

$(\log A)_0$ is the value of log A at $F=F_0$;

$F_0$ is the starting frequency; and $F_{co}$ is the cut-off frequency, i.e., the overall limit to the frequency range in which the system will seek the bell point (which depends on the type of fuel and burner).

Preferably, both functions $f_1(A)^m$ and $f_2(F)^n$ are be presented in the same (linear or exponential) form. The form of presentation should be selected to obtain the desired sensitivity and the desired flame parameter. For example, when a statistical parameter with high sensitivity, is desired, the $f_1(A)^m$ function can be presented in the log form for many coal-fired burners. Or when it is desired to use a statistical parameter with low sensitivity, the $f_2(F)^n$ function can be presented in the exponential form for many gas-fired burners.

After the extremum function is formed, the position of the extremum (i.e., bell point) is used as a threshold to divide the function's spectrum into several frequency segments. The number of segments and their size should be selected empirically for acceptable results; the sizes at least in some cases are not critical. In a simple case, for example, the spectrum can be divided into three segments: the extremum segment (IF), the low-frequency segment (LF) to the left of the extremum segment, and the high-frequency segment (HF) to the right of the extremum segment, as illustrated in FIG. 3a.

Next, a set of values is calculated for one or more predetermined (statistical) parameters $p_i$ of the extremum function in frequency segment i, for each segment. These may be amplitudes, areas, slopes, etc. (which have been demonstrated to correlate with flame characteristics, such as NOx, flame stability or air-fuel ratio, through a mechanism of turbulent mixing and eddy formation). That is, the values are calculated for parameters $p_{ix}$ where i=0 . . . q and x=1 . . . r, q being the number of segments and r being the number of parameters evaluated in each segment ("r" can vary from segment to segment).

Along with the calculation of each value of parameter $p_{ix}$, its degree of scattering $s_{ix}$ is calculated; $s_{ix}$ is also known as standard deviation. (For simplicity, $p_{ix}$ and $s_{ix}$ will be written hereafter as $p_i$ and $s_i$, respectively, it being understood that there may be multiple parameters monitored in each or any segment.) The degree of scattering, in addition to its direct meaning as a measure of noise for the main parameter $p_i$, has an additional important meaning: it provides an indication of an independent flame parameter, such as flame stability. Preferably, a combination of at least two calculated values $p_i$ and $s_j$ is used, where the index "i" refers to the parameter value in a first frequency segment, "i", and the index "j" refers to a value in another segment, "j". It is believed that in some systems, a single parameter $p_i$ may be sufficient. This approach will provide a better and more complete flame characterization because, as often happens, an improvement in one flame parameter leads to an excessive degradation of another parameter(s). For example, it is well known, that gradually reducing burner excess air in efforts to lower NOx, at a certain point leads to a sharp increase of CO (combustibles) and unburned carbon, as well as to a reduction in flame stability. It is very important, when trying to optimize one flame parameter, such as NOx, to monitor the behavior of other parameters and to be ready to limit further changes when other parameters show signs of degradation. The scattering parameter, $s_j$, serves this purpose: it introduces an additional independent limiting factor, thus providing a basis for achieving both burner adjustment and burner optimization.

The operator, manually, or a control system, automatically, then may use the parametric values to deduce burner operating conditions and make adjustments.

If necessary, one can employ additional limiting parameters (p's or s's) calculated for varying frequency segments, depending on the burner operating conditions.

The extremum function Y will change its position, as shown in FIG. 3*a*, according to changes in flame conditions. It may float to the right as at 52, to the left as at 54, up as at 56 or down (not shown). Load changes generally would cause the function to shift up or down, and changes in fuel-to-air ratio or in air distribution will shift the extremum point to the left or to the right. The resulting calculated values will change automatically, following the changes in the extremum position. Selection of the calculated $p_i$ and $s_j$ functions will depend on the individual burner and flame conditions and practical requirements. These calculations can be made using the parameters in their absolute or normalized forms. For example, in order to generate an output signal independent of burner load, the calculated value should be normalized in relation to the current value of $Y_{max}$. In general, the $Y_{max}$ value provides a well defined, dynamic and adjustable floating reference for signal normalization. The normalized value of a particular parameter or function is obtained by dividing that value by $Y_{max}$.

The interplay between an exemplary parameter $p_i$ and its scattering function $s_i$, and their correlation with NOx emission. As seen there, the parameter $p_i$ is well-correlated with NOx; indeed, it varies approximately linearly with NOx. The associated scattering function, $s_i$, decreases in some non-linear way with increasing concetrations of amounts of NOx.

Figure 4F:
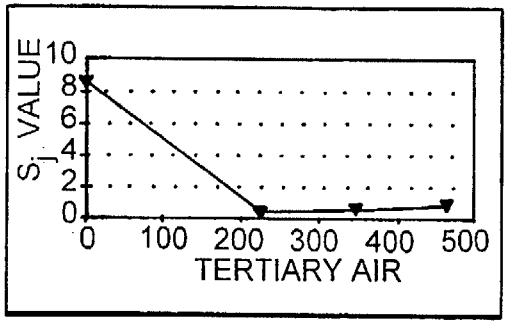
FIGS. 4*a*–4*f* are two sets of graphs illustrating the dependency of the scattering function, s, of an exemplary flame signal parameter, p, in a first frequency segment, i, and a second frequency segment, j, and averaged values which result therefrom.
Figure 4D:
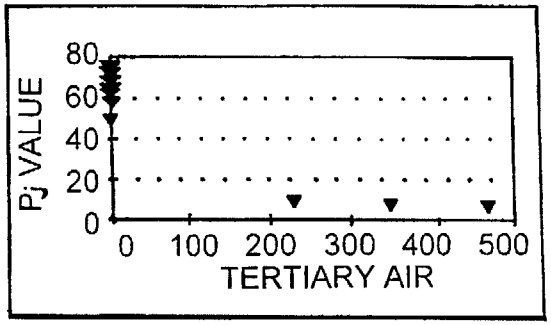
Figure 4E:
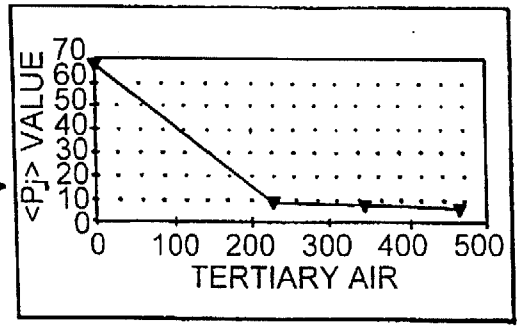
Figure 4C:
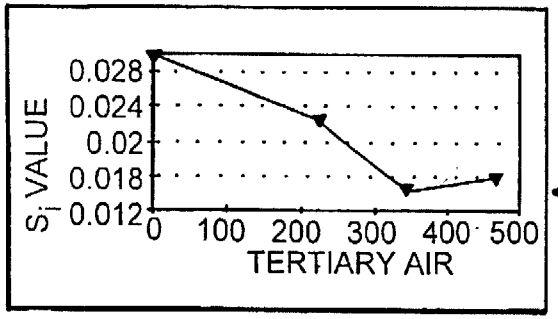
Figure 4A:
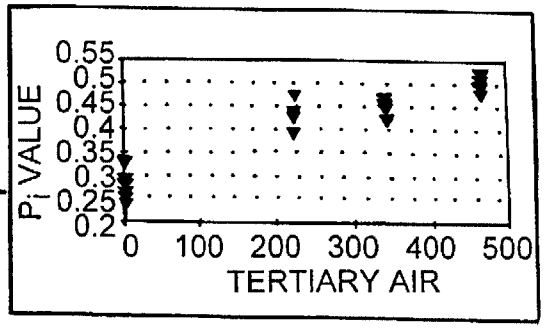

FIGS. 4*a*–4*c* and 4*d*–4*e* illustrate for respective frequency segments i and j a set of samples with parameter ($p_i$ or $p_j$), a plot of the averaged values thereof, and a plot of the associated scattering signal. More specifically, there is seen in FIG. 4*a* a plot of several values of the parameter $p_i$ graphed against the amount of tertiary air supplied to the flame. The data of FIG. 4*a* is averaged to produce the signal <pi> graphed in FIG. 4*b*. The associated scattering signal $s_i$ is shown in FIG. 4*c*. Note that the slope of the graph of FIG. 4*b* indicates sensitivity of the parameter to changes in air supply. For high measurement reliability, generally it will be desired to look for a combination of the averaged $p_i$ signal and the scattering signal which yields high scattering values which suggest that the parameter is not very useful to describe flame characteristics.

Figure 4B:
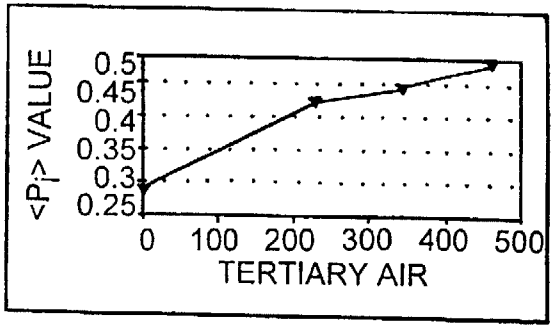

FIGS. 4*d*–4*f* are similar to FIGS. 4*a*–4*c*, but note how differently the same parameter performs in two different frequency segments. Of course, the actual sample values and their averages will depend on the selected parameter measured as well as burner conditions. One skilled in the art will, with relatively little experimentation, be able to determine a useful combination of parameters to monitor and the frequency segments in which they provide the highest signal-to-noise ratio. Calculated values for $p_i$ and $s_i$ can change either in the same or in opposite directions with changes in a control variable, such as air flow. This will be seen in FIGS. 4*a*–4*f*, for example. As observed in FIG. 4*b*, in frequency segment "i", the average value of parameter $p_i$ increases with increased tertiary air flow, while in FIG. 4*e*, the average value of the same parameter, in a different segment, falls with increasing tertiary air flow. In both frequency segments, the scattering values for the parameter fall with increasing air flow until a minimum is reached and then very slowly increase.

Figure 5:
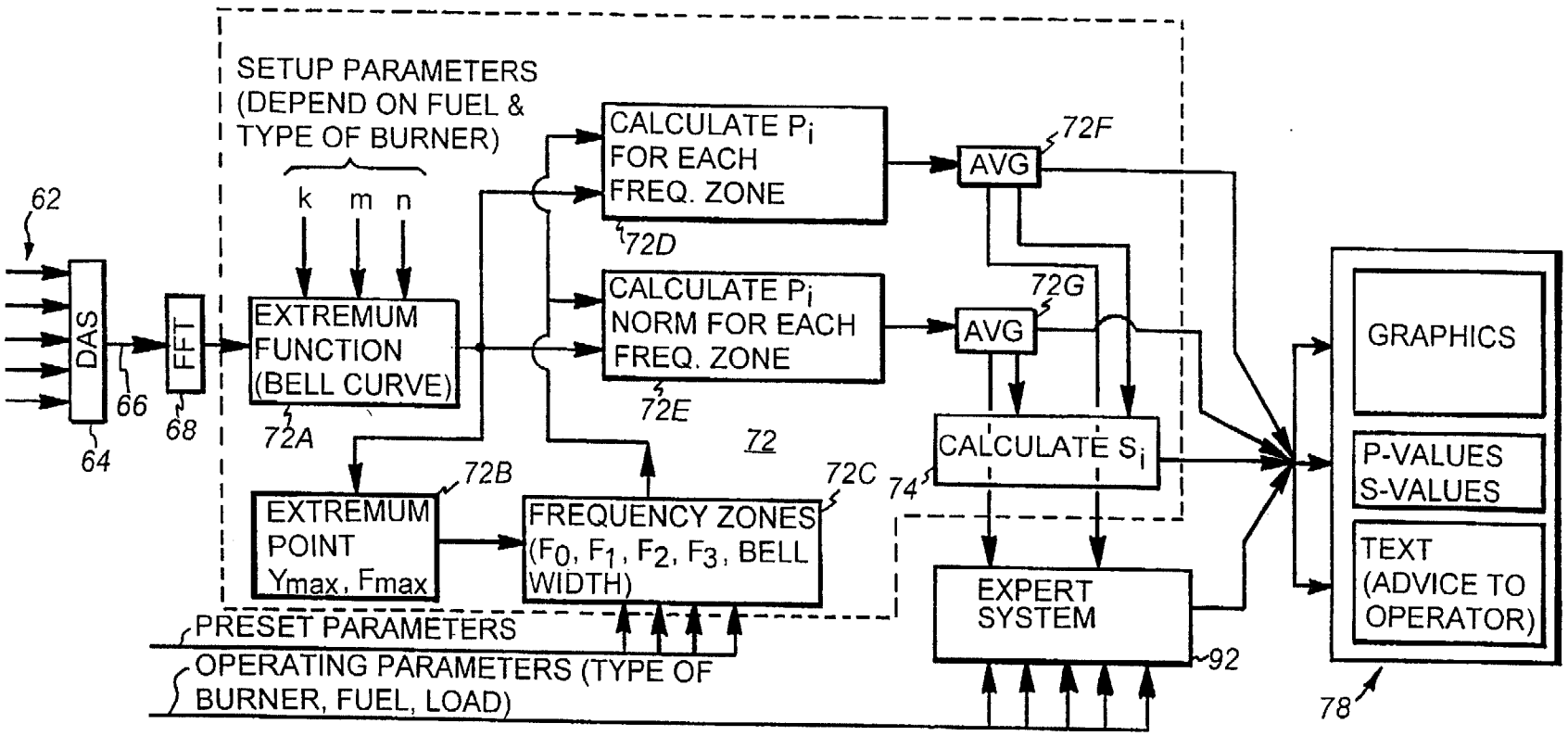
FIG. 5 is an example of a system architecture for an exemplary implementation of the present invention.

FIG. 5 illustrates an exemplary system architecture for practicing the above-described method. Input flame radiation signals, usually in the analog form, from conventional burner flame sensors (e.g., from existing flame scanners of any make or type) are supplied on lines 62 to a data acquisition subsystem (DAS) 64 which receives, isolates, multiplex, amplifies, digitizes and couples these input signals onto a bus 66.

Figure 6:
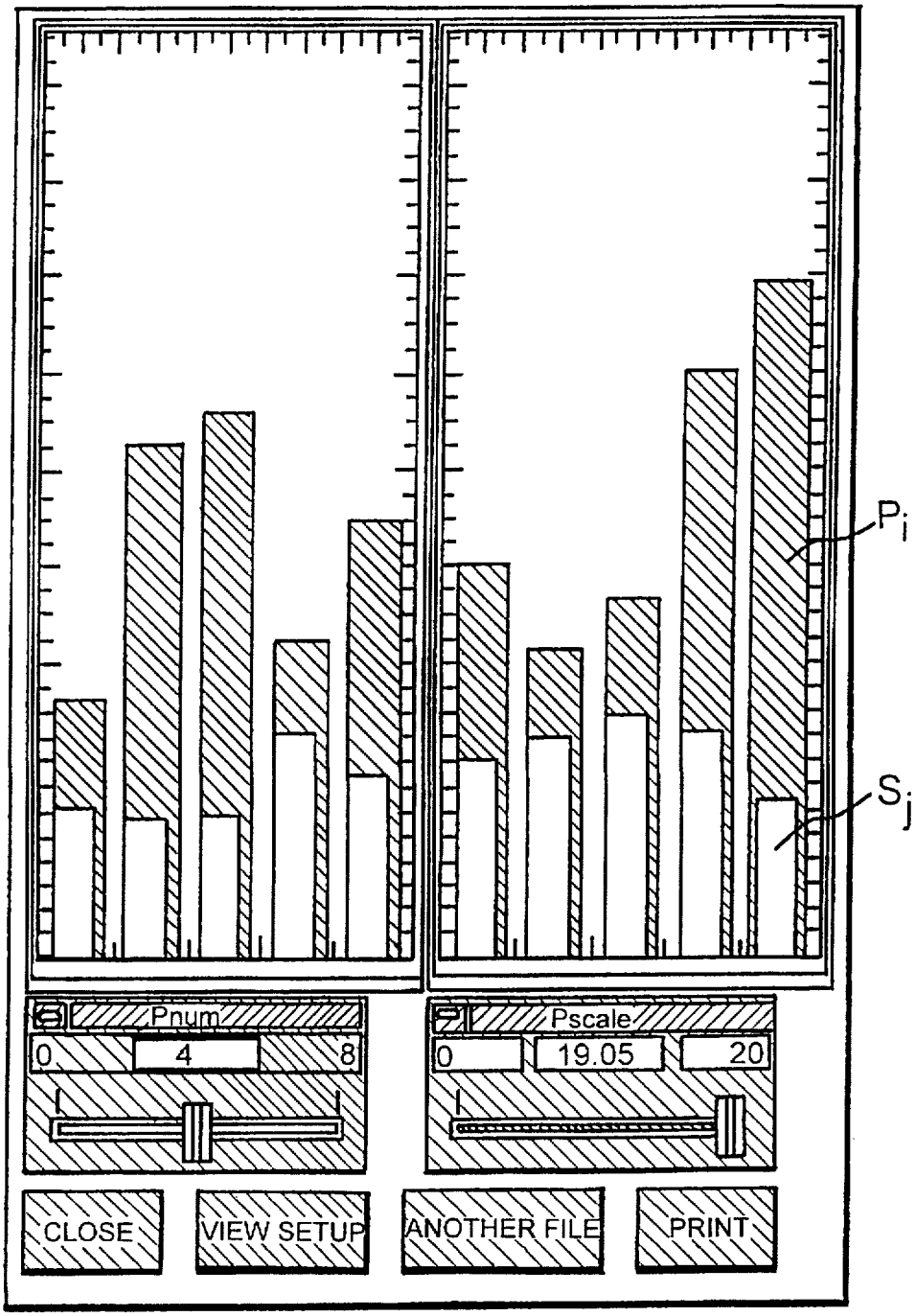
FIG. 6 is an example of a useful combined presentation of values of $p_i$ and $s_j$ in bar graph form, for two groups of burners having five burners each.

From DAS 64 the signals in a digitized form are converted into the frequency domain using a conventional FFT 68. Using the frequency domain signals from FFT 68, a processor unit 72 performs various calculations. Rather than depict the operation of the processor unit in a separate flow chart, FIG. 5 shows schematically within processor unit 72, the various calculations. From the FFT output, the processor unit calculates the selected extremum function such as $Y=kf_1(A)^m f_2(F)^n$; where parameters k, m and n must be preset, depending on type of fuel, type of burner and its operating conditions. Step 72A. After this function Y is calculated, the processor automatically determines the extremum coordinates $Y_{max}$ and $F_{max}$, step 72B, determines the frequency segments or zones (i.e., their number and location) (step 72C) and calculates predetermined statistical $p_i$ parameters for each frequency segment, preferably in both absolute form (step 72D) and normalized forms (step 72E) —i.e., divided by $Y_{max}$. The $p_i$ values preferably are then averaged (steps 72F and 72G, respectively). The degree of scattering $s_i$ is calculated also for each of the selected $p_i$ parameters (step 74). The calculated averaged $p_i$ and $s_i$ values are transmitted to an operator interface sub-system 78 which uses conventional software to generate graphical images presenting the combination of "p" and "s" values for the controlled flames, to an operator's display. These p and s values for each controlled flame may be presented, for example, in a bar graph form, or in a trend (time series) form, or both, or in some other form. FIG. 6 gives an example of a bar graph presentation where the s values are "inserted" inside the p bars; these may be $s_i$ or $s_j$ values in $p_i$ bars, i.e., they may correspond to the same or another frequency segment, but in the illustration $s_j$ values are shown in $p_i$ bars.

Another subsystem 92 is a so-called "expert system" which receives the calculated $p_i$ and $s_i$ values for each burner and generates advice to the operator. This advice preferably is supported by an estimated degree of confidence which is a function of the calculated $s_i$ values. This system takes into account the values and trends of changes in each of individual parameters $p_i$ and $s_i$, and develops advice to the operator, such as for example "increase secondary air to burner A1" or "reduce swirl on burner B2", which advice is supported by an estimated degree of confidence for the proposed advice. Those skilled in the art will appreciate that an expert of this type may to some extent be generic but that much of the knowledge base of the system will have to be developed empirically for each type of burner and fuel.

Having described an exemplary embodiment of the invention, it will now be apparent to those skilled in the art that the inventive method may be practiced on a variety of apparatus. For example, processor unit 72 may be in whole or in part dedicated hardware—i.e., circuitry—or it may be programmable general purpose digital computer or CPU (or multiple CPUs), with steps 72A–72G and 74 being performed by executing on the computer processor unit(s) suitable programming instructions. Such implementations may appear quite dissimilar to that shown herein without departing from the spirit and scope of the invention.

What is claimed is:

1. A signal processing method for analyzing operation of a combustion burner, comprising the steps of:

a. responsive to a signal produced by a flame sensor monitoring a burner flame converting a fluctuational component of the signal into an extremum function with a floating spectrum point having a frequency coordinate which varies in the frequency domain with changes in combustion conditions;

b. calculating a current extremum value of the extremum function; and c. calculating a value of at least one parameter of the extremum function, the at least one parameter being defined in relation to the current extremum value of the extremum function and being related to a combustion characteristic.

2. The method of claim 1, wherein the step of calculating the value of the at least one parameter includes calculating a plurality of values of the at least one parameter, and wherein the method further comprises the step of calculating an average value of the plurality of values of the at least one parameter.

3. The method of claim 2, further comprising the step of calculating a standard deviation of the plurality of values of the at least one parameter.

4. The method of claim 1, wherein the step of calculating the value of the at least one parameter includes calculating a plurality of values of the at least one parameter, and wherein the method further comprises the step of normalizing the plurality of values of the at least one parameter relative to a normalizing value to establish a plurality of normalized parameter values.

5. The method of claim 4, wherein the step of normalizing the plurality of values of the at least one parameter includes normalizing the plurality of values of the at least one parameter in relation to the current extremum value of the extremum function.

6. The method of claim 4, further comprising the step of calculating an average value of the plurality of normalized parameter values.

7. The method of claim 6, further comprising the step of calculating a standard deviation of the plurality of normalized parameter values.

8. The method of claim 1, further comprising the steps of:

calculating a combustion characteristic value based at least in part on the value of the at least one parameter to yield a calculated combustion characteristic value, comparing the calculated combustion characteristic value with an expected combustion characteristic value, and generating advice based at least in part upon a difference between the calculated combustion characteristic value and the expected combustion characteristic value.

9. The method of claim 1, wherein step (c) includes the step of dividing the extremum function into a plurality of frequency segments in relation to a frequency coordinate corresponding to the current extremum value of the extremum function; and wherein the at least one parameter of the extremum function is defined in relation to one of the plurality of frequency segments.

10. The method of claim 1, wherein the at least one parameter of the extremum function for which a value is calculated in step (c) is defined in relation to a frequency coordinate corresponding to the current extremum value of the extremum function.

11. A method for analyzing a flame, comprising the steps of:

monitoring the flame with a sensor to produce a signal representative of radiation from the flame;

generating an extremum function based upon a fluctuational component of the signal, the extremum function having a floating extremum point with a frequency coordinate which varies in the frequency domain with changes in combustion conditions;

determining a current extremum value of the extremum function; and calculating a value of at least one parameter of the extremum function, the at least one parameter being defined in relation to the current extremum value and being related to a combustion characteristic.

12. The method of claim 11, wherein the step of generating the extremum function includes the steps of: (a) processing the signal to obtain a frequency domain amplitude spectrum corresponding to the fluctuational component of the signal, and (b) mapping the frequency domain amplitude spectrum into a preselected function dependent at least in part on amplitude and frequency.

13. The method of claim 12, wherein the step of processing the signal includes the step of generating a Fast Fourier Transform of the signal.

14. The method of claim 11, wherein the step of calculating the value of the at least one parameter of the extremum function includes the step of dividing the extremum function into a plurality of frequency segments in relation to a frequency coordinate corresponding to the current extremum value of the extremum function; and wherein the at least one parameter of the extremum function is defined in relation to one of the plurality of frequency segments.

15. The method of claim 11, wherein the at least one parameter of the extremum function for which a value is calculated is defined in relation to a frequency coordinate corresponding to the current extremum value of the extremum function.

16. A system for analyzing a flame, comprising:

a processor adapted to be coupled to a flame sensor to receive a signal that is representative of radiation from a flame;

a memory coupled to the processor, the memory having stored therein a plurality of instructions, which, when executed by the processor, cause the processor to perform the steps of:

generating an extremum function based upon a fluctuational component of the signal, the extremum function having a floating extremum point with a frequency coordinate which varies in the frequency domain with changes in combustion conditions;

determining a current extremum value of the extremum function; and calculating a value of at least one parameter of the extremum function, the at least one parameter being defined in relation to the current extremum value and being related to a combustion characteristic.

17. The system as claimed in claim 16, further comprising the flame sensor, the flame sensor being coupled to the processor to provide the processor with the signal representative of radiation from the flame.

18. The system as claimed in claim 16, further comprising a display coupled to the processor to display the value of the at least one parameter or a value derived from the value of the at least one parameter.

19. The system as claimed in claim 16, wherein the step of calculating the value of the at least one parameter of the extremum function includes the step of dividing the extremum function into a plurality of frequency segments in relation to a frequency coordinate corresponding to the current extremum value of the extremum function; and wherein the at least one parameter of the extremum function is defined in relation to one of the plurality of frequency segments.

20. The system as claimed in claim 16, wherein the at least one parameter of the extremum function for which a value is calculated is defined in relation to a frequency coordinate corresponding to the current extremum value of the extremum function.

21. A system for analyzing condition of a burner producing a flame, comprising:

means responsive to a signal produced by a flame sensor monitoring a burner flame, for converting a fluctuational component of the signal into an extremum function with a floating extremum point having a frequency coordinate which varies in the frequency domain with changes in combustion conditions;

means for calculating a current extremum value of the extremum function; and means for calculating a value of at least one parameter of the extremum function, the at least one parameter being defined in relation to the current extremum value of the extremum function and being related to a combustion characteristic.

22. The system as claimed in claim 21, wherein the means for calculating the value of the at least one parameter of the extremum function includes means for dividing the extremum function into a plurality of frequency segments in relation to a frequency coordinate corresponding to the current extremum value of the extremum function; and wherein the at least one parameter of the extremum function is defined in relation to one of the plurality of frequency segments.

23. The system as claimed in claim 21, wherein the means for calculating includes means for calculating the value of the at least one parameter of the extremum function wherein the at least one parameter of the extremum function is defined in relation to a frequency coordinate corresponding to the current extremum value of the extremum function.

24. The system as claimed in claim 21, further comprising a display coupled to the calculating means to display the value of the at least one parameter or a value derived from the value of the at least one parameter.

25. A computer-readable medium having a plurality of instructions stored thereon, the plurality of instructions including instructions that, when executed by a processor, cause the processor to perform the steps of:

responsive to a signal produced by a flame sensor monitoring a burner flame, converting a fluctuational component of the signal into an extremum function with a floating extremum point having a frequency coordinate which varies in the frequency domain with changes in combustion conditions;

calculating a current extremum value of the extremum function; and calculating a value of at least one parameter of the extremum function, the at least one parameter being defined in relation to the current extremum value of the extremum function and being related to a combustion characteristic.

26. The computer-readable medium as claimed in claim 25, wherein the step of calculating the value of the at least one parameter of the extremum function includes the step of dividing the extremum function into a plurality of frequency segments in relation to a frequency coordinate corresponding to the current extremum value of the extremum function; and wherein the at least one parameter of the extremum function is defined in relation to one of the plurality of frequency segments.

27. The computer-readable medium as claimed in claim 25, wherein the at least one parameter of the extremum function for which a value is calculated is defined in relation to a frequency coordinate corresponding to the current extremum value of the extremum function.

28. A signal processing method for analyzing operation of a combustion burner, comprising the steps of:

responsive to a signal produced by a flame sensor monitoring a burner flame, converting a fluctuational component of the signal into an extremum function with a floating extremum point having a frequency coordinate which varies in the frequency domain with changes in combustion conditions;

calculating a current extremum value of the extremum function; and using the current extremum value to analyze the operation of the combustion burner.

* * * * *